US009157225B2

(12) United States Patent
Kashirajima et al.

(10) Patent No.: US 9,157,225 B2
(45) Date of Patent: Oct. 13, 2015

(54) FLUSH TOILET

(71) Applicant: TOTO LTD., Kitakyushu-shi, Fukuoka (JP)

(72) Inventors: Shu Kashirajima, Kitakyushu (JP); Tomohiro Hirakawa, Kitakyushu (JP); Masaki Kitamura, Kitakyushu (JP); Yuki Shinohara, Kitakyushu (JP); Koji Kamei, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 70 days.

(21) Appl. No.: 14/226,414

(22) Filed: Mar. 26, 2014

(65) Prior Publication Data

US 2015/0082531 A1 Mar. 26, 2015

(30) Foreign Application Priority Data

Sep. 26, 2013 (JP) ..... 2013-200275

(51) Int. Cl.
*E03D 11/00* (2006.01)
*E03D 11/08* (2006.01)

(52) U.S. Cl.
CPC ..... *E03D 11/08* (2013.01); *E03D 11/00* (2013.01)

(58) Field of Classification Search
CPC ..... E03D 11/02
USPC ..... 4/420
See application file for complete search history.

(56) References Cited

U.S. PATENT DOCUMENTS

| | | | |
|---|---|---|---|
| 7,827,628 | B2 | 11/2010 | Ichiki et al. |
| 2006/0005310 | A1 | 1/2006 | Nakamura et al. |

FOREIGN PATENT DOCUMENTS

| | | |
|---|---|---|
| JP | 2002138555 | 5/2002 |
| JP | 2006104936 | 4/2006 |
| JP | 3975486 | 9/2007 |
| JP | 2011157738 | 8/2011 |

*Primary Examiner* — Lori Baker
(74) *Attorney, Agent, or Firm* — Brooks Kushman P.C.

(57) ABSTRACT

A flush toilet which includes: a bowl portion having a waste-receiving surface, a rim and a recess; a first rim spout portion which spouts flush water toward a front end of the bowl portion so as to form a swirl flow; and a second rim spout portion which spouts flush water so as to form a swirl flow having a same flow direction as that of the swirl flow formable by the first rim spout portion. The bowl portion is configured to allow flush water spouted from the first rim spout portion to form a major stream which flows from the front end of the bowl portion into the recess, and allow flush water spouted from the second rim spout portion to flow into the recess from a lateral side of the bowl portion and then merge with the major stream M.

20 Claims, 9 Drawing Sheets

FLUSH TOILET

CROSS-REFERENCE TO RELATED APPLICATIONS

This application claims priority to JP application JP 2013-200275 filed on Sep. 26, 2013, the disclosure of which is incorporated in its entirety by reference herein.

TECHNICAL FIELD

The present invention relates to a flush toilet, and more particularly to a flush toilet capable of efficiently discharging floating pieces of waste in a bowl portion into a drainage conduit while allowing them to sink into pooled water, thereby improving waste discharge performance.

BACKGROUND

Heretofore, there has been known a flush toilet in which flush water spouted from a first spout portion for rim water flows along a shelf, and, after swirlingly flowing downwardly while flushing (cleaning) a waste-receiving surface of a bowl portion, flows into a bottom of the bowl, and water spouted from a second spout portion for jet water flows downwardly into the bottom of the bowl portion to agitate pooled water within the bowl portion in an up-down direction, as described, for example, in JP 3975486B (Patent Document 1).

There has also been known a flush toilet in which flush water is spouted only from two rim spout ports, i.e., first and second spout ports for rim water, and supplied onto a waste-receiving surface of a bowl portion in the form of a swirling flow, as described, for example, in JP 2011-157738A (Patent Document 2). This flush water is configured such that flush water flowing out of the second spout port is supplied toward an inlet of a drainage trap while flowing downwardly along an inwardly convexedly curved surface continuously extending rearwardly from a rear end of a standing surface of the bowl portion.

SUMMARY

Technical Problem

The flush toilet described in the Patent Document 1 is equipped with the second spout port for agitating pooled water in the up-down direction, so that it is excellent in terms of capability of discharging floating pieces of waste. On the other hand, an amount of flush water to be spouted from the first spout port to wash the waste-receiving surface is reduced, thereby leading to a problem of failing to sufficiently flush (clean) the waste-receiving surface.

The flush toilet described in the Patent Document 2 is capable of sufficiently flushing the waste-receiving surface with flush water spouted from the two rim spout ports, i.e., the first and second spout ports for rim water. On the other hand, this flush toilet is incapable of agitating pooled water with floating pieces of waste in an up-down direction, thereby leading to a problem of failing to adequately discharge the floating pieces of waste, resulting in stay thereof. Thus, in the flush toilet configured such that flush water is spouted only from the first and second spout ports for rim water, in what manner flush water is agitated in an up-down direction is one technical problem.

Therefore, the present invention has been made to solve the conventional problems and address the technical problem, and an object thereof is to provide a flush toilet capable of efficiently discharging floating pieces of waste in a bowl portion into a drainage conduit while allowing them to sink into pooled water, thereby improving waste discharge performance.

Solution to the Technical Problem

In order to achieve the above object, the present invention provides a flush toilet which flushes a toilet main unit with flush water supplied from a flush water source to thereby discharge waste. The flush toilet comprises: a bowl portion having a bowl-shaped waste-receiving surface, a rim located along an upper edge thereof, and a recess formed below the waste-receiving surface, wherein the recess has a bottom located below a pooled water level, and a wall connecting between the bottom and a lower edge of the waste-receiving surface; a first rim spout portion located on a first one of laterally opposite sides of the bowl portion, and configured to spout flush water toward a front end of the bowl portion so as to form a swirl flow which swirlingly flows along an inner peripheral surface of the rim; a second rim spout portion located on the other, second, side of the bowl portion, and configured to spout flush water so as to form a swirl flow having a same flow direction as that of the swirl flow formable by the first rim spout portion; and a drainage conduit having an inlet connecting with the recess so as to discharge waste there through, wherein the bowl portion is configured to allow flush water spouted from the first rim spout portion to form a major stream which flows from the front end of the bowl portion into the recess, and allow flush water spouted from the second rim spout portion to flow into the recess from a lateral side of the bowl portion and then merge with the major stream from a transverse direction of the recess.

In the flush toilet of the present invention, a major stream of the flush water spouted from the first rim spout portion flows from the front end of the bowl portion into the recess, and the flush water spouted from the second rim spout portion merges with the major stream which has flowed into the recess, from the transverse direction, so that it is possible to effectively agitate pooled water within the recess in an up-down direction. That is, it is possible to sufficiently flush the waste-receiving surface of the bowl portion with respective flush water flows spouted from the first and second rim spout portions, and generate an up-down agitation flow within the recess. This makes it possible to efficiently discharge floating pieces of waste in the bowl portion into the drainage conduit while allowing them to sink into pooled water, thereby improving waste discharge performance.

Preferably, in the flush toilet of the present invention, the bowl portion is configured to allow most of the flush water spouted from the second rim spout portion to flow into the recess from the lateral side of the bowl portion.

According to this feature, the flush water spouted from the first rim spout portion flows, a major stream, from the front end of the bowl portion into the recess, and most of the flush water spouted from the second rim spout portion merges with the major stream which has flowed into the recess, from the transverse direction, so that it is possible to effectively agitate pooled water within the recess in the up-down direction. That is, it is possible to sufficiently flush the waste-receiving surface of the bowl portion with respective flush water flows spouted from the first and second rim spout portions, and generate an up-down agitation flow within the recess. This makes it possible to efficiently discharge floating pieces of waste in the bowl portion into the drainage conduit while allowing them to sink into pooled water, thereby improving waste discharge performance.

Preferably, in the flush toilet of the present invention, the waste-receiving surface of the bowl portion has a rear waste-receiving sub-surface in a rear region thereof, wherein the rear waste-receiving sub-surface is formed in a shelf shape in a downstream area of second rim spout portion, in such a manner as to allow the flush water spouted from the second rim spout portion to be guided to a front region of the recess while flowing thereon.

According to this feature, the flush water spouted from the second rim spout portion is guided to the front region of the recess while flowing on the shelf-shaped rear waste-receiving sub-surface, so that it is possible to allow the flush water spouted from the second rim spout portion to reliably merge with the major stream from the first rim spout portion, from the transverse direction, thereby effectively agitating pooled water within the recess in the up-down direction. That is, it is possible to sufficiently flush the waste-receiving surface of the bowl portion with respective flush water flows spouted from the first and second rim spout portions, and generate an up-down agitation flow within the recess. This makes it possible to efficiently discharge floating pieces of waste into the drainage conduit while allowing them to sink into pooled water, thereby improving waste discharge performance.

Preferably, the above flush toilet satisfies the following relationship: $2 \leq L/w2 \leq 10$, where L represents a width of the shelf-shaped rear waste-receiving sub-surface, and w2 represents a width of the second rim spout portion.

According to this feature, the ratio (L/w2) of the width (L) of the shelf-shaped rear waste-receiving sub-surface to the width (w2) of the second rim spout portion is set in the range of 2 to 10, so that it is possible to guide the flush water spouted from the second rim spout portion, to the front region of the recess while flowing on the shelf-shaped rear waste-receiving sub-surface, and thus allow the flush water spouted from the second rim spout portion to reliably merge with the major stream from the first rim spout portion, from the transverse direction, thereby effectively agitating pooled water within the recess in the up-down direction. That is, it is possible to sufficiently flush the waste-receiving surface of the bowl portion with respective flush water flows spouted from the first and second rim spout portions, and generate an up-down agitation flow within the recess. This makes it possible to efficiently discharge floating pieces of waste into the drainage conduit while allowing them to sink into pooled water, thereby improving waste discharge performance.

More preferably, in the above flush toilet, the recess is configured, in top plan view, such that the bottom is formed in the front region thereof, and an area of the bottom is equal to or greater than one-half of an area of the pooled water surface.

According to this feature, in top plan view, the area of the bottom formed in the front region of the recess is equal to or greater than one-half of the area of the pooled water surface, so that the flush water spouted from the second rim spout portion dives down to the bottom of the recess, thereby effectively forming a flow for agitating pooled water in the up-down direction along the wall of the recess. That is, it is possible to sufficiently flush the waste-receiving surface of the bowl portion with respective flush water flows spouted from the first and second rim spout portions, and generate an up-down agitation flow within the recess. This makes it possible to efficiently discharge floating pieces of waste into the drainage conduit while allowing them to sink into pooled water, thereby improving waste discharge performance.

Preferably, in the flush toilet of the present invention, the bowl portion is formed with a water guide channel for allowing the flush water spouted from the first rim spout portion to swirlingly flow along the inner peripheral surface of the rim, wherein the water guide channel is formed to extend from the first rim spout portion toward the front end of the bowl portion while gradually inclining downwardly and then extending rearward from the front end while gradually inclining upwardly.

According to this feature, the water guide channel is formed in the bowl portion to allow the flush water spouted from the first rim spout portion to swirlingly flow along the inner peripheral surface of the rim, in such a manner that it extends from the first rim spout portion toward the front end of the bowl portion while gradually inclining downwardly and then extending rearward from the front end while gradually inclining upwardly, so that it is possible to allow the flush water from the first rim spout portion to effectively flow, as a major stream, from the front end of the bowl portion into the recess. It is also possible to allow the flush water spouted from the second rim spout portion to merge with the major stream which has flowed into the recess, from the transverse direction, thereby effectively agitating pooled water within the recess in the up-down direction. That is, it is possible to sufficiently flush the waste-receiving surface of the bowl portion with respective flush water flows spouted from the first and second rim spout portions, and generate an up-down agitation flow within the recess. This makes it possible to efficiently discharge floating pieces of waste into the drainage conduit while allowing them to sink into pooled water, thereby improving waste discharge performance.

More preferably, in the above flush toilet, the waste-receiving surface is formed to, along a line approximately equally distant from the rim in an intermediate region of the waste-receiving surface in its longitudinal direction, extends, in the first side, toward the front end of the bowl portion while gradually inclining downwardly, and further extends, in the second side, toward a rear end of the bowl portion while gradually inclining upwardly.

According to this feature, the waste-receiving surface is formed to, along the line approximately equally distant from the rim in the intermediate region of the waste-receiving surface in its longitudinal direction, extends, in the first side, toward the front end of the bowl portion while gradually inclining downwardly, and further extends, in the second side, toward the rear end of the bowl portion while gradually inclining upwardly, so that it is possible to allow a part of the flush water spouted from the second rim spout portion to flow into the recess from a forward side thereof, after merging with the flush water spouted from the first rim spout portion.

Preferably, the flush toilet of the present invention, the first rim spout portion has an opening formed in a vertically-long flat shape.

According to this feature, the first rim spout portion has an opening formed in a vertically-long flat shape, so that it is possible to allow the flush water spouted from the first rim spout portion to swirlingly flow to the front end of the bowl portion while avoiding an undesirable situation where the spouted flush water immediately falls onto the waste-receiving surface, thereby effectively forming a major flow flowing from the front end of the bowl portion into the recess.

DETAILED DESCRIPTION

With reference to the accompanying drawings, a flush toilet according to one embodiment of the present invention will now be described.

Figure 1:
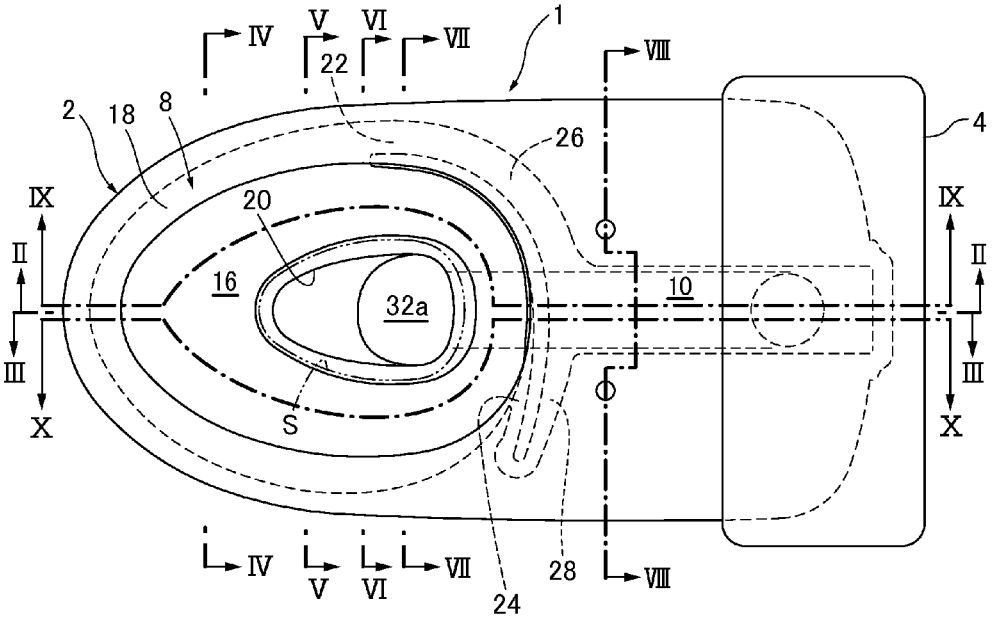
FIG. 1 is a top plan view illustrating a flush toilet according to one embodiment of the present invention.
Figure 2:
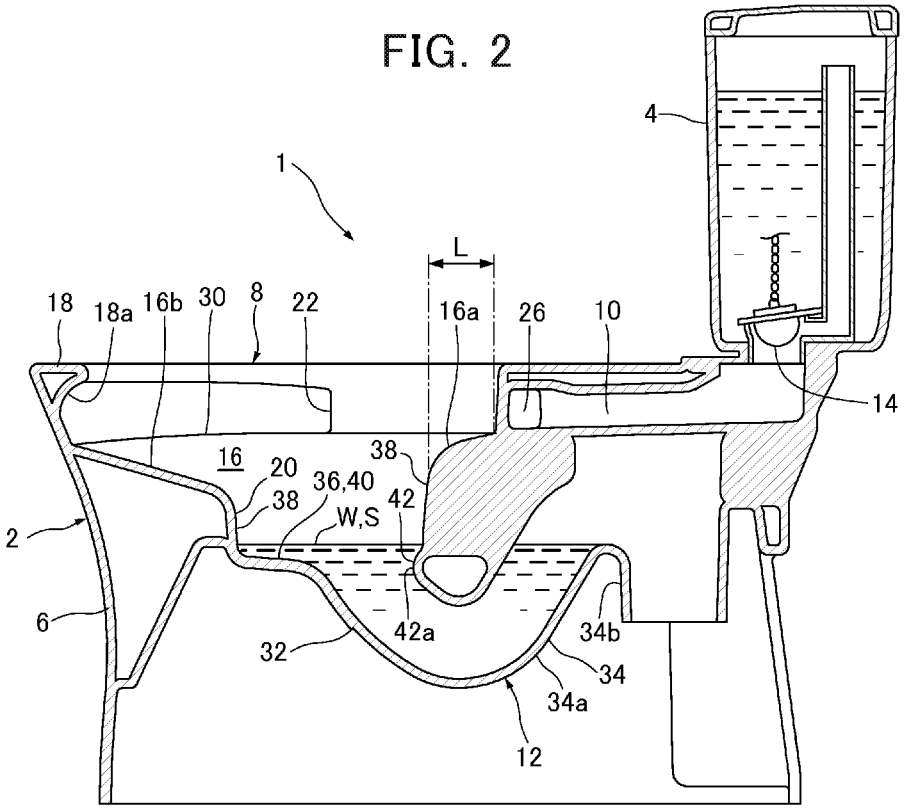
FIG. 2 is a sectional view taken along the line II-II in FIG. 1.
Figure 3:
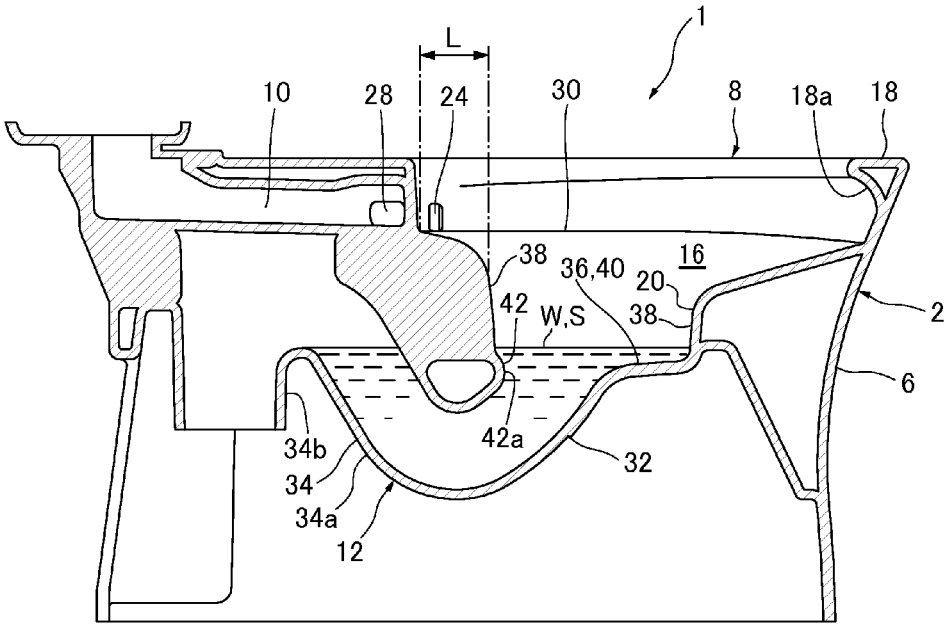
FIG. 3 is a sectional view taken along the line in FIG. 1.
Figure 4:
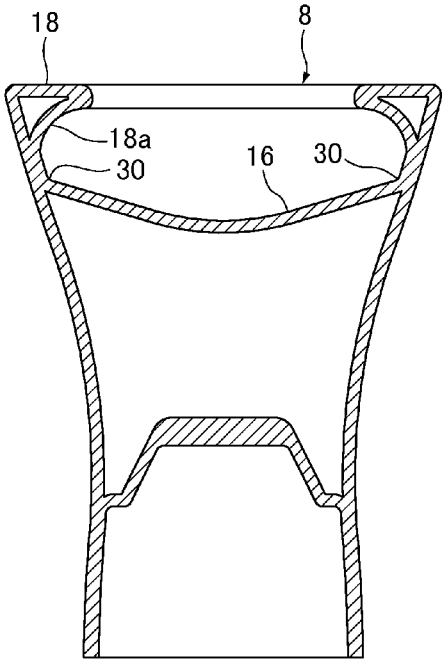
FIG. 4 is a sectional view taken along the line IV-IV in FIG. 1.
Figure 5:
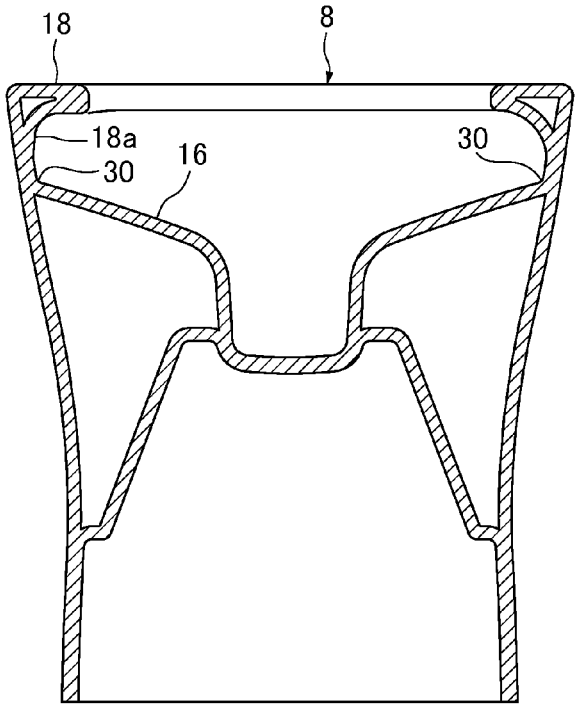
FIG. 5 is a sectional view taken along the line V-V in FIG. 1.
Figure 6:
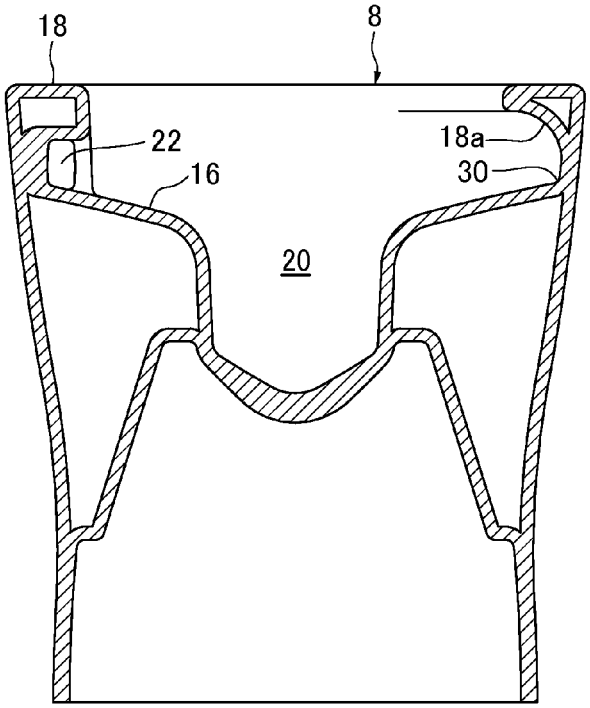
FIG. 6 is a sectional view taken along the line VI-VI in FIG. 1.
Figure 7:
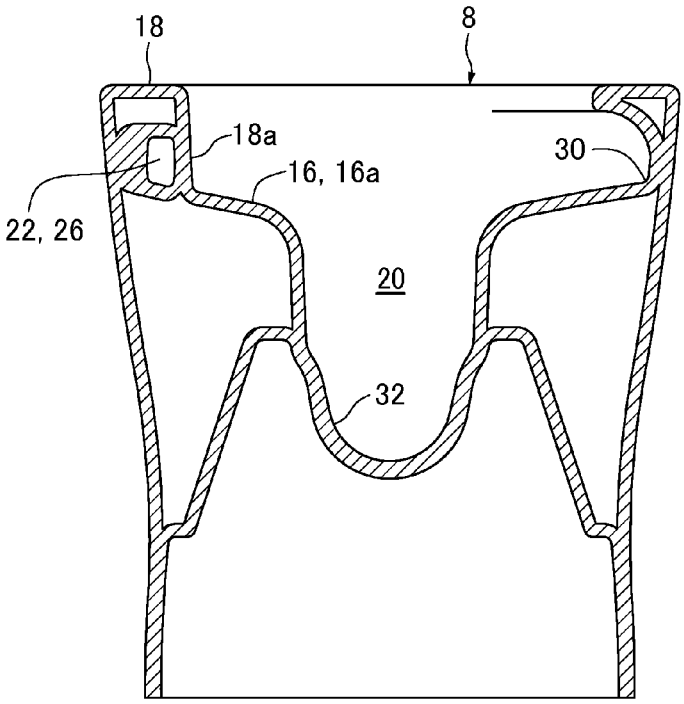
FIG. 7 is a sectional view taken along the line VII-VII in FIG. 1.
Figure 8:
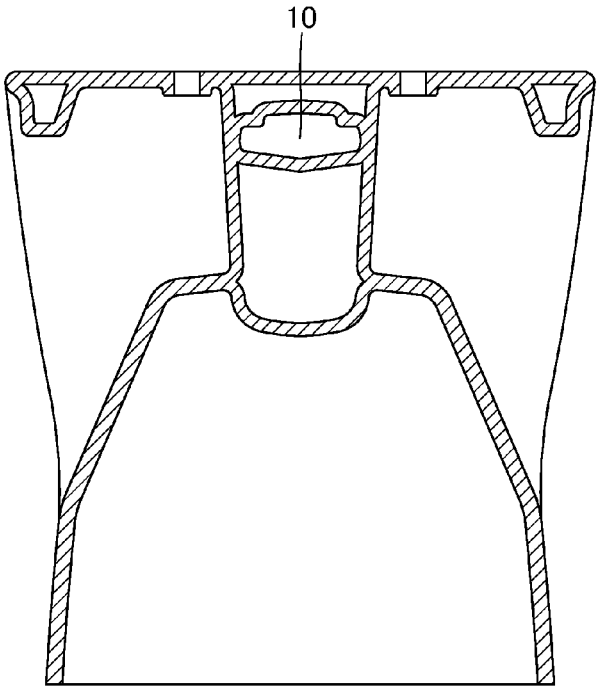
FIG. 8 is a sectional view taken along the line VIII-VIII in FIG. 1.

First of all, with reference to FIGS. 1 to 8, a fundamental structure of the flush toilet according to this embodiment will be described. FIG. 1 is a top plan view illustrating the flush toilet according to this embodiment, and FIG. 2 and FIG. 3 are, respectively, a sectional view taken along the line II-II in FIG. 1 and a sectional view taken along the line in FIG. 1. FIG. 4, FIG. 5 and FIG. 6 are, respectively, a sectional view taken along the line IV-IV in FIG. 1, a sectional view taken along the line V-V in FIG. 1 and a sectional view taken along the line VI-VI in FIG. 1. FIG. 7 is a sectional view taken along the line VII-VII in FIG. 1, and FIG. 8 is a sectional view taken along the line VIII-VIII in FIG. 1.

As illustrated in FIGS. 1 and 3, the flush toilet 1 is a wash-down toilet configured to wash down waste by an action of flowing water arising from a water head difference within a bowl portion, wherein it comprises a toilet main unit 2, and a reservoir tank 4 which stores therein flush water for flushing the toilet main unit 2. The toilet main unit 2 is a porcelain product having a glaze layer formed on a surface thereof, wherein it has a lower section formed as a skirt 6, and an upper section having a front half formed as a bowl portion 8. The upper section also has a rear half in which an upper area thereof is formed with a common water flow passage 10 having an upstream end communicating with the reservoir tank 4, and a lower area thereof is formed with a drainage conduit 12 for discharging waste there through.

The reservoir tank 4 serves as a flush water source. The reservoir tank 4 is internally provided with a discharge valve 14 configured to be opened by a manual operation lever (not illustrated). It is to be understood that, as the flush toilet according to this embodiment, it is possible to use a direct-pressure flush toilet of a type which is devoid of the reservoir tank 4 and in which flush water is directly supplied from a city water line, a flush toilet of a type in which flush water is supplied via a flush valve, and others.

The bowl portion 8 has a bowl-shaped waste-receiving surface 16, a rim 18 located along an upper edge thereof, and a recess 20 formed below the bowl-shaped waste-receiving surface 16. In this embodiment, as illustrated in FIGS. 2 to 7, the rim 18 is formed such that an inner peripheral surface 18*a* thereof has an inwardly overhanging shape to prevent flush water being swirlingly flowing from jumping out of the rim 18.

The toilet main unit 2 is provided with a first spout port 22 and a second spout port 24 each for spouting flush water therefrom, wherein the first spout port 22 is provided at a position slightly rearward of a mid-region in a left (in front view) half of the inner peripheral surface of the rim 18 of the bowl portion 8, and the second spout port 24 is provided in a rear region in a right (in front view) half of the inner peripheral surface of the rim 18. Each of the first spout port 22 and the second spout port 24 is configured to allow flush water to swirlingly flow in the same direction (in FIG. 1, in a counter-clockwise direction) to thereby form a swirl flow.

The common water flow passage 10 formed in the upper area of the rear half of the upper section of the toilet main unit 2 is branched into a first water flow passage 26 and a second water flow passage 28 each extending in a forward direction of the main unit 2. The first water flow passage 26 is configured to supply flush water to the first spout port 22, and the second water flow passage 28 is configured to supply flush water to the second spout port 24.

In the flush toilet 1 according to this embodiment, the first water flow passage 26 including the first spout port 22, and the second water flow passage 28 including the second spout port 24, are integrally formed with the porcelain toilet main unit 2. However, the present invention is not limited to this configuration, but the first water flow passage 26 including the first spout port 22 and the second water flow passage 28 including the second spout port 24 may be formed by providing a distributor or the like as a component separate from the toilet main unit.

In the flush toilet 1 according to this embodiment, as illustrated in FIGS. 2 to 7, the waste-receiving surface 16 of the bowl portion 8 is formed in an upwardly convex shape over the entire region thereof, along radial lines oriented toward an inlet of the drainage conduit 12.

Further, as illustrated in FIGS. 2 and 3, the bowl portion 8 has a water guide channel 30 formed in a region just below the inner peripheral surface 18*a* of the rim 8 to guide flush water. The water guide channel 30 is designed to allow flush water spouted from the first spout port 22 to swirlingly flow along the inner peripheral surface 18*a* of the rim 8, and formed to extend from the first spout port 22 toward a front end of the bowl portion 8 while gradually inclining downwardly (see FIG. 2), and then extending rearward from the front end while gradually inclining upwardly (see FIG. 3). Flush water spouted from the first spout port 22 is guided to swirlingly flow along the water guide channel 30, so that it becomes possible to form a large-flow-rate major stream M (see FIG. 11) which flows from the front end of the bowl portion 8 toward an inlet 32*a* of an after mentioned introduction conduit portion 32 of the drainage conduit 12.

As illustrated in FIGS. 2 and 3, the drainage conduit 12 comprises an introduction conduit portion 32 connecting with an after mentioned bottom of the recess 20 and extending rearward and obliquely downwardly, and a drainage trap conduit portion 34 connecting with the introduction conduit portion 32 and extending upwardly. The drainage trap conduit portion 34 is composed of a rising section (rising conduit portion) 34*a* and a lowering section (lowering conduit portion) 34*b*.

The introduction conduit portion 32 is formed as a smooth curved surface connecting with the after mentioned bottom of the recess 20, so that flush water flowing from the recess 20 into the introduction conduit portion 32 smoothly flows through the introduction conduit portion 32.

Next, with reference to FIGS. 1 to 7 and 9 to 11, the waste-receiving surface 16 and the recess 20 in the bowl portion 8 will be described in detail.

Figure 9:
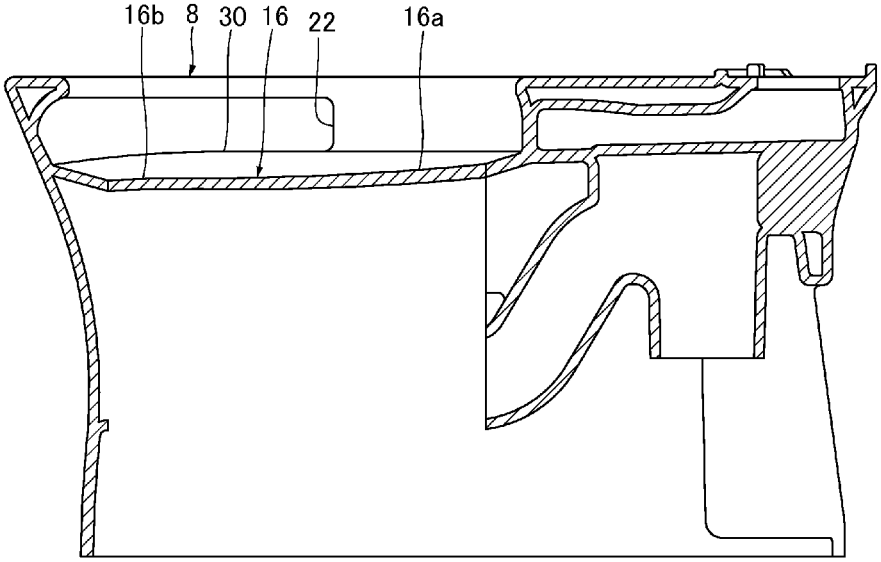
FIG. 9 is a sectional view taken along the line IX-IX in FIG. 1.
Figure 10:
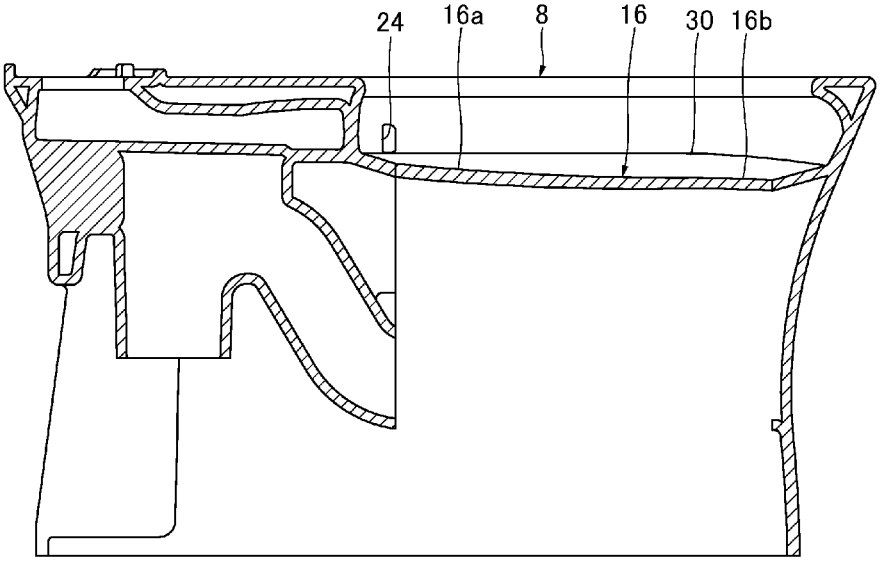
FIG. 10 is a sectional view taken along the line X-X in FIG. 1.
Figure 11:
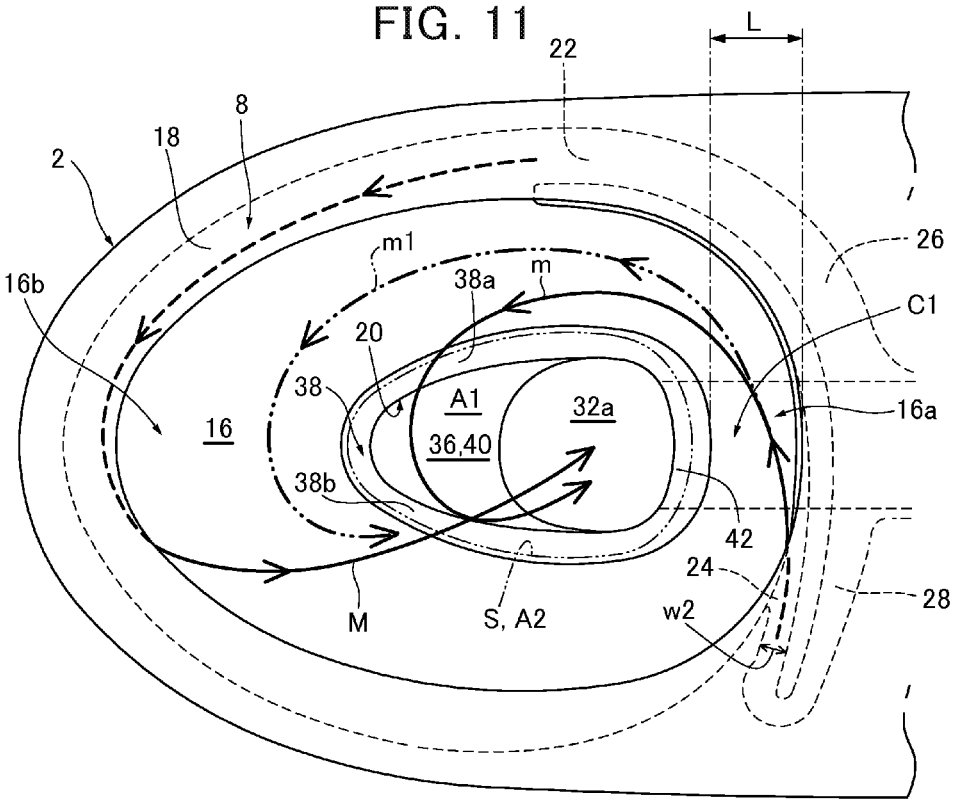
FIG. 11 is a fragmentary enlarged top plan view fragmentarily and enlargedly illustrating a bowl portion of a toilet main unit in the flush toilet according to the embodiment of the present invention illustrated in FIG. 1.

FIG. 9 and FIG. 10 are, respectively, a sectional view taken along the line IX-IX in FIG. 1 and a sectional view taken along the line X-X in FIG. 1, and FIG. 11 is a fragmentary enlarged top plan view fragmentarily and enlarged illustrating the bowl portion of the toilet main unit in the flush toilet according to the embodiment illustrated in FIG. 1. In a rear waste-receiving sub-surface 16*a* and a front waste-receiving sub-surface 16*b*, each of the line IX-IX and the line X-X in FIG. 1 lies along a center line of the bowl portion extending in a forward-rearward direction thereof, and in an intermediate region of the waste-receiving surface 16 between the rear and front waste-receiving sub-surfaces 16*a*, 16*b*, each of the line IX-IX and the line X-X lies along a line approximately equally distant from the rim 18.

As illustrated in FIGS. 1 to 7 and 9 to 11, the waste-receiving surface 16 is formed to extend from a laterally approximately central area C1 of the rear waste-receiving sub-surface 16*a* toward the front end of the bowl portion 6 (i.e., a front end of waste-receiving sub-surface 16*b*) while gradually inclining downwardly, and then extent from the front end toward the rear end of the bowl portion 6 while gradually inclining upwardly.

Further, as illustrated in FIGS. 2 to 7, the rear waste-receiving sub-surface 16*a* is formed in a shelf shape in a downstream area of the second spout port 24 in the rear region of the waste-receiving surface 16. Thus, a flow (major stream) m of most of flush water spouted from the second spout port 24 to the laterally approximately central area C1 of the rear waste-receiving sub-surface 16*a* is guided to swirlingly flow along the shelf-shaped rear waste-receiving sub-surface 16*a*, while passing behind the recess 20 and then passing laterally beside the recess 20 (passing by a left side of the recess 20 when viewed rearwardly from the forward side thereof), and form a transverse flow directed toward an inside of the recess 20, as illustrated in FIG. 11.

An amount of flush water to be spouted from the second spout port 24 is set to be less than an amount of large-flow-rate flush water to be spouted from the first spout port 22. For example, 60% to 90% of a total amount of flush water passing through the common water flow passage 10 is spouted from the first spout port 22 via the first water flow passage 26, and 10% to 40% of the total amount of flush water passing through the common water flow passage 10 is spouted from the second spout port 24 via the second water flow passage 28.

Preferably, an amount of the flow (stream) m, i.e., an amount of the most of flush water, to be spouted from the second spout 24 (amount), is set to be approximately equal to or greater than 50% of a total amount of flush water to be spouted from the second spout port 24.

The above configuration allows a part ml of the flush water spouted from the second spout port 24 to merge with the flush water spouted from the first spout port 22 and being flowing, as the large-flow-rate major stream M, from the front end of the bowl portion 8 toward the recess 20, and then flow into the recess 20 from the forward side thereof together with the major stream M.

As illustrated in FIGS. 2, 3 and 11, the recess 20 of the bowl portion 8 has a bottom 36 located below a pooled water level W, and a wall 38 connecting between the bottom 36 and a lower edge of the waste-receiving surface 16. The bottom 36 has a front bottom surface 40 formed in a region of the recess 20 forward of the inlet 32*a* of the introduction conduit portion 32, and a rear bottom surface 42 formed in a region of the recess 20 rearward of the inlet 32*a* of the introduction conduit portion 32.

The front bottom surface 40 of the bottom 36 of the recess 20 is formed to extend horizontally. Alternatively, the front bottom surface 40 may be formed to gradually incline rearwardly and obliquely downwardly.

The front bottom surface 40 of the recess 20 is formed such that the entire region thereof is located below the pooled water level W, and above a lower end 42*a* of the rear bottom surface 42.

On the other hand, the rear bottom surface 42 of the bottom 36 of the recess 20 is formed to extend toward a front region of the introduction conduit portion 32, while inclining inwardly and obliquely downwardly. The rear bottom surface 42 of the recess 20 is formed such that the entire region thereof is located below the pooled water level W. The rear bottom surface 42 of the recess 20 is not necessarily a flat surface, but may be formed as a curved surface which is slightly curved in an upwardly convex manner.

As illustrated in FIG. 11, in top plan view, an area A1 of the front bottom surface 40 is set to be greater than one-half of an area A2 of a pooled water surface S. Thus, the flow (major stream) m of most of flush water spouted from the second spout port 24 to the laterally approximately central area C1 of the rear waste-receiving sub-surface 16*a* is guided to swirlingly flow along the shelf-shaped rear waste-receiving sub-surface 16*a*, while passing behind the recess 20 and then passing laterally beside the recess 20 (passing by the left side of the recess 20 when viewed rearwardly from the forward side thereof), and form a transverse flow directed toward the inside of the recess 20, as illustrated in FIG. 11. Then, the transverse flush water flow (stream) m dives from a position approximately just above a left wall surface 38*a* of the recess 20, to the front bottom surface 40 along the left wall surface 38*a*.

The flush water flow m which has dived in the recess 20 effectively forms a flow capable of effectively agitating pooled water in an up-down direction while swirlingly flowing upwardly from the front bottom surface 40 along a right wall surface 38*b* of the recess 20. Then, the flow m merges with the large-flow-rate major stream M spouted from the first spout port 22 and flowing from the front end of the bowl portion into the recess 20.

Although this embodiment has been described based on an example where the area A1 of the front bottom surface 40 is set to be greater than one-half of the area A2 of the pooled water surface S, in top plan view, as illustrated in FIG. 11, the area A1 of the front bottom surface 40 may be set to be equal to one-half of the area A2 of the pooled water surface S. In sum, the area A1 of the front bottom surface 40 may be set to be equal to or greater than one-half of the area A2 of the pooled water surface S.

Next, based on FIGS. 11 to 13, the first spout port 22 and the second spout port 24 in the bowl portion 8 will be described in detail.

Figure 12:
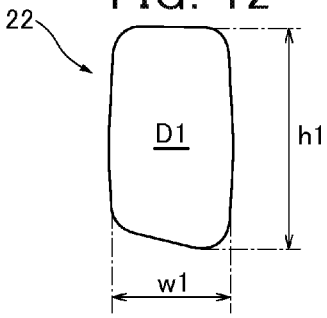
FIG. 12 is a sectional view illustrating a first spout port in the flush toilet according to the embodiment of the present invention.
Figure 13:
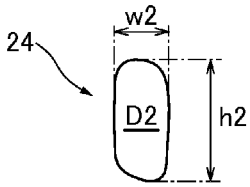
FIG. 13 is a sectional view illustrating a second spout port in the flush toilet according to the embodiment of the present invention.

FIG. 12 is a sectional view illustrating the first spout port in the flush toilet according to this embodiment, and FIG. 13 is a sectional view illustrating the second spout port in the flush toilet according to this embodiment.

As illustrated in FIG. 12, an opening cross-section D1 of the first spout port 22 is formed in a vertically-long flat shape, and a passage cross-section of the first water flow passage 26 reaching the opening cross-section D1 of the first spout port 22 is also formed in a vertically-long flat shape, over approximately the entire region of the first spout port 22. Thus, it is possible to allow flush water spouted from the first spout port 22 after passing through the first water flow passage 26 to swirlingly flow to at least the front end of the bowl portion 8 while avoiding an undesirable situation where most of the flush water falls onto the front waste-receiving sub-surface 16*b* immediately after the spouting, thereby effectively forming the major flow M flowing from the front end of the bowl portion into the recess.

In this regard, a ratio of a maximum height dimension h1 to a maximum width dimension w1 (ratio h1/w1) in the opening cross-section D1 of the first spout port 22 is set preferably in the range of 1 to 5, more preferably, in the range of 1.5 to 3.

As illustrated in FIG. 13, an opening cross-section D2 of the second spout port 24 is formed in a vertically-long flat shape, as with the opening cross-section D1 of the first spout port 22, although an area of the opening cross-section D2 is set to be less than that of the opening cross-section D1. Thus, it is possible to allow flush water spouted from the second spout port 22 after passing through the second water flow passage 28 to swirlingly flow to a position approximately just above the left wall surface 38*a* of the recess 20 while avoiding an undesirable situation where most of the flush water falls from the shelf-shaped rear waste-receiving sub-surface 16*a* into a rear region of the recess 20 immediately after the spouting from the second spout port 22.

In this regard, a ratio of a maximum height dimension h2 to a maximum width dimension w2 (ratio h2/w2) in the opening cross-section D2 of the second spout port 24 is set preferably in the range of 1 to 5, more preferably, in the range of 1.5 to 3.

As illustrated in FIGS. 2, 3, 11 and 13, a ratio of a longitudinal width L of the laterally approximately central area C1 of the shelf-shaped rear waste-receiving sub-surface 16*a*, to the maximum width w2 of the second spout port 24 (ratio L/w2) is set preferably in the range of 2 to 10, more preferably, in the range of 3 to 9, most preferably, in the range of 4 to 8. Thus, as illustrated in FIG. 11, the flow (major stream) m of most of flush water spouted from the second spout port 24 to the laterally approximately central area C1 of the rear waste-receiving sub-surface 16*a* is guided to swirlingly flow along the shelf-shaped rear waste-receiving sub-surface 16*a*, while passing behind the recess 20 and then passing laterally beside the recess 20 (passing by the left side of the recess 20 when viewed rearwardly from the forward side thereof), and form a transverse flow directed toward the inside of the recess 20, and the transverse flow is introduced into the front region of the recess 20, so that it is possible to allow the major stream m of flush water spouted from the second spout port 24 to reliably merge with the major stream M spouted from the first spout port 22, from the transverse direction of the recess 20, thereby effectively agitating pooled water in an up-down direction.

Next, with reference to FIGS. 1 to 16, a flushing operation of the flush toilet according to this embodiment will be described.

Figure 14:
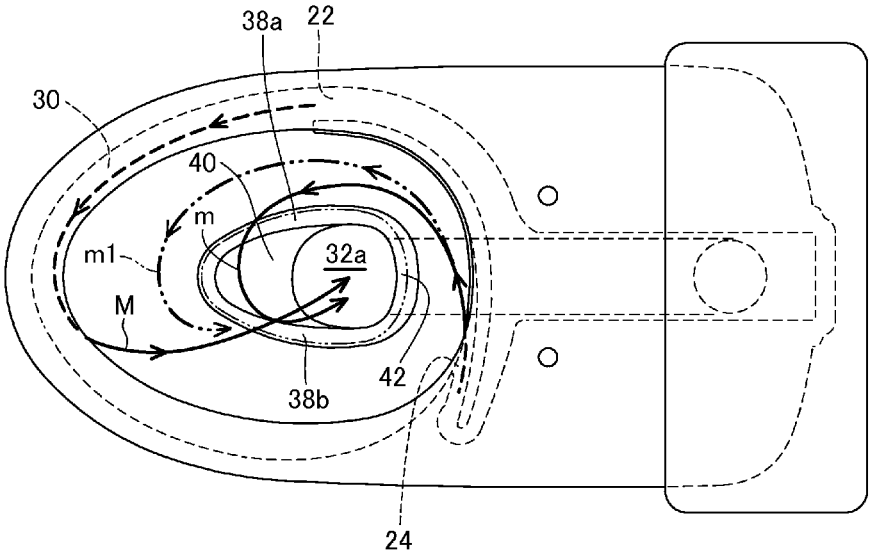
FIG. 14 is a top plan view illustrating a state of a flow of flush water in the flush toilet according to the embodiment of the present invention.
Figure 15:
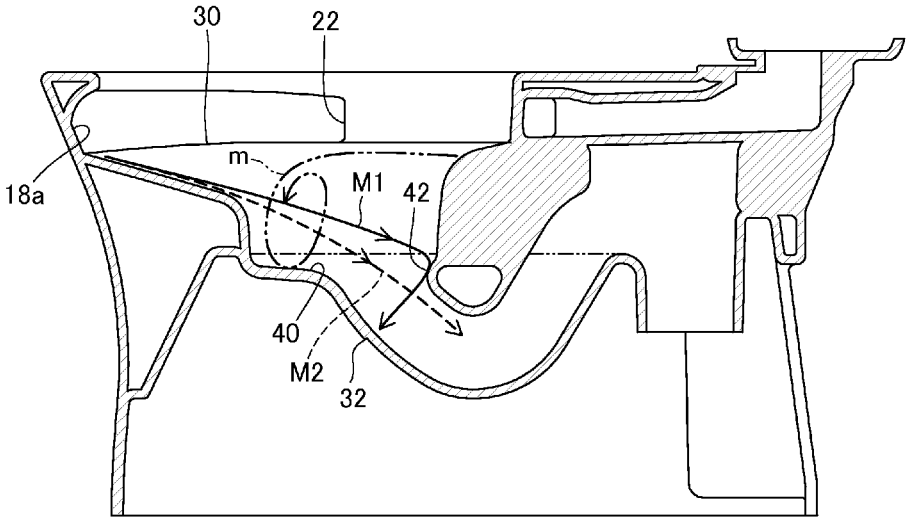
FIG. 15 is a sectional view of the flush toilet in FIG. 14.
Figure 16:
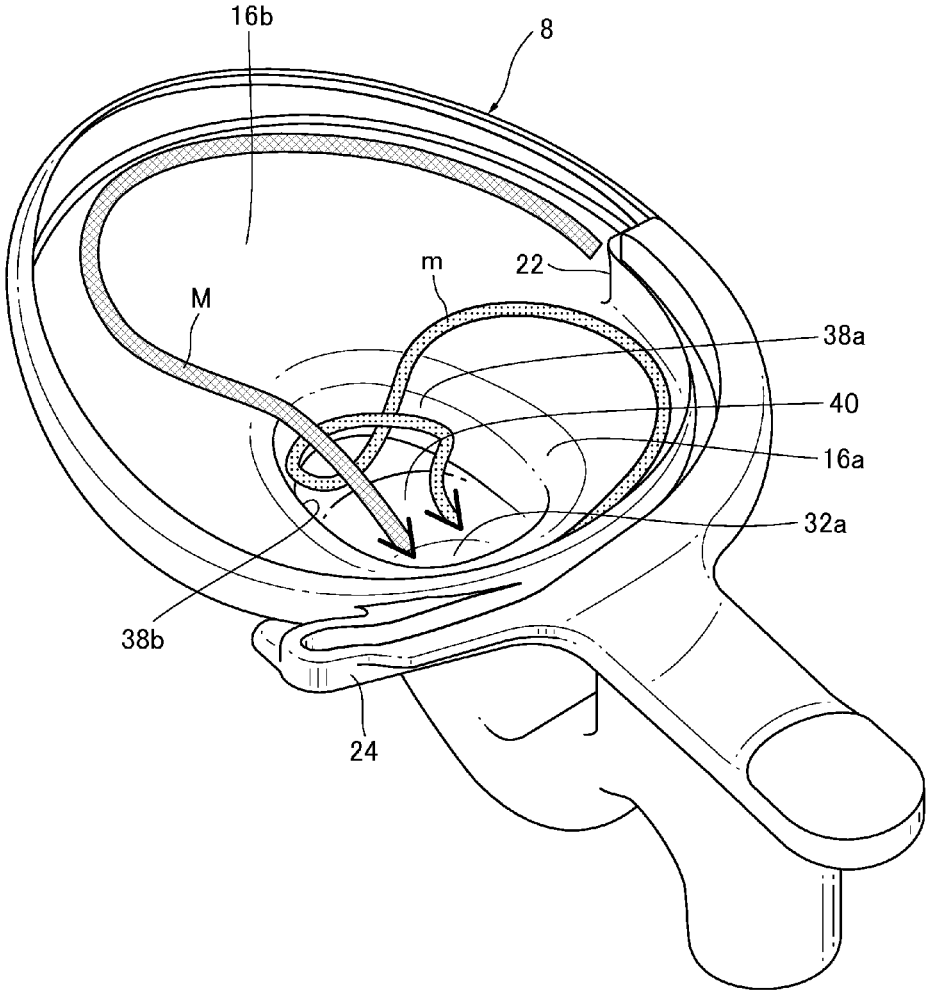
FIG. 16 is a schematic perspective view illustrating a state of a flow of flush water in the flush toilet according to the embodiment of the present invention.

FIG. 14 and FIG. 15 are, respectively, is a top plan view illustrating a state of a flow of flush water in the flush toilet according to this embodiment, and a sectional view of the flush toilet in FIG. 14, and FIG. 16 is a schematic perspective view illustrating a state of a flow of flush water in the flush toilet according to this embodiment.

First of all, when a user operates the manual operation lever (not illustrated) of the reservoir tank 4, the discharge valve 14 is opened, so that flush water in the reservoir tank 4 is supplied to the common water flow passage 10, and spouted from the first spout port 22 and the second spout port 24 via the first water flow passage 26 and the second water flow passage 28 branched from the common water flow passage 10.

Flush water spouted from the first spout port 22 is guided to flow forwardly along the water guide channel 30 formed just below the inner peripheral surface 18*a* of the rim 18 of the bowl portion 8, and then, after passing through the front end of the bowl portion 8, flowing rearward. In this process, a part of the flush water falls along the bowl portion 8 while swirlingly flowing, thereby flushing or cleaning the waste-receiving surface 16.

Further, a substantial portion of the flush water spouted from the first spout port 22 and guided to flow along the water guide channel 30 forms a large-flow-rate major stream M which is directed to flow from the front end of the bowl portion 8 toward the inlet 32*a* of the introduction conduit portion 32 of the drainage conduit 12 (see FIGS. 14 and 16). A part M1 of the major stream M collides with the rear bottom surface 42 of the bottom 36 of the recess 20, and then flows out forwardly and obliquely downwardly toward the front region inside the introduction conduit portion 32 (see FIG. 15). On the other hand, a remaining part M2 of the major stream M directly flows into the inlet 32*a* of the introduction conduit portion 32 (see FIG. 15).

In this regard, in the above embodiment, the bowl portion 8 is formed with the water guide channel 30 for allowing flush water to swirlingly flow along the inner peripheral surface of the rim 18, wherein the water guide channel 30 is formed to extend from the first spout port 22 toward the front end of the bowl portion 8 while gradually inclining downwardly and then extend rearwardly from the front end while gradually inclining upwardly, so that it is possible to form the major stream M with a large flow rate. In addition, the part M1 of the major stream M is brought into collision with the rear bottom surface 42 of the bottom 36 of the recess 20, and the collided major stream M1 is guided to flow toward the front region inside the introduction conduit portion 32. Particularly, the rear bottom surface 42 of the bottom 36 is formed to incline inwardly and obliquely downwardly, so that it is possible to smoothly guide the partial major stream M1 after colliding with the rear bottom surface 42, toward the front region of the introduction conduit portion 32. Concurrently, a remaining part M2 of the major stream flows into the rear region of the introduction conduit portion 32.

On the other hand, flush water spouted from the second spout port 24 falls along the bowl portion 8 while swirlingly flowing, thereby flushing or cleaning the rear region of the waste-receiving surface 16. As illustrated in FIGS. 14 to 16, the flow (major stream) m of most of flush water spouted from the second spout port 24 to the laterally approximately central area C1 of the rear waste-receiving sub-surface 16*a* is guided to swirlingly flow along the shelf-shaped rear waste-receiving sub-surface 16*a*, while passing behind the recess 20 and then passing laterally beside the recess 20 (passing by the left side of the recess 20 when viewed rearwardly from the forward side thereof), and form a transverse flow directed toward the inside of the recess 20.

Further, as illustrated in FIG. 14, the part ml of the flush water spouted from the second spout port 24 merges with the flush water spouted from the first spout port 22 and being flowing, as the major stream M, from the front end of the bowl portion 8 toward the recess 20, and then flow into the recess 20 from the forward side thereof together with the major stream M.

Then, the transverse flow (stream) m of flush water flowing into the recess 20 dives from a position approximately just above the left wall surface 38*a* of the recess 20, to the front bottom surface 40 along the left wall surface 38*a*. The flush water flow m which has dived in the recess 20 forms a flow capable of effectively agitating pooled water in the up-down direction while swirlingly flowing upwardly from the front bottom surface 40 along the right wall surface 38*b* of the recess 20. Then, the flow m of flush water from the second spout port 24 merges with the large-flow-rate major stream M spouted from the first spout port 22 and flowing from the front end of the bowl portion into the recess 20. More specifically, the flow m of flush water from the second spout port 24 is moved upwardly due to the collision with the front bottom surface 40, and mixed with the major streams M1, M2 flowing there above. This makes it possible to effectively agitate pooled water with waste to allow the waste to smoothly flow into the introduction conduit portion 32.

As mentioned above, in the flush toilet 1 according to the above embodiment of the present invention, flush water spouted from the first spout port 22 flows, as a major stream M, from the front end of the bowl portion 8 into the recess 20, and flush water spouted from the second spout port 24 merges with the major stream M which has flowed into the recess 20, from a transverse direction of the recess 20, so that it is possible to effectively agitate pooled water within the recess 20 in the up-down direction. That is, it is possible to sufficiently flush the waste-receiving surface 16 of the bowl portion 8 with respective flush water flows spouted from the first and second spout ports 22, 24, and generate an up-down agitation flow m within the recess 20. This makes it possible to efficiently discharge floating pieces of waste in the bowl portion 8 into the drainage conduit while allowing them to sink into pooled water, thereby improving waste discharge performance.

In the flush toilet 1 according to the above embodiment, the waste-receiving surface 16 of the bowl portion 8 has a rear waste-receiving sub-surface in a rear region thereof, wherein the rear waste-receiving sub-surface 16 is formed in a shelf shape in a downstream area of the second spout port 24, and wherein the ratio L/w2 of the width L of the shelf-shaped rear waste-receiving sub-surface 16*a* to the maximum width w2 of the second spout port 24 is set in the range of 2 to 10, whereby the flush water spouted from the second spout port 24 is guided to the front region of the recess 20 while flowing on the rear waste-receiving sub-surface 16*a*. Thus, it is possible to allow the flush water spouted from the second spout port 24 to reliably merge with the major stream M spouted from the first spout port 22, from the transverse direction of the recess 20, thereby effectively agitating pooled water within the recess 20 in the up-down direction. That is, it is possible to sufficiently flush the waste-receiving surface 16 of the bowl portion 8 with respective flush water flows spouted from the first and second spout ports 22, 24, and generate an up-down agitation flow m within the recess 20. This makes it possible to efficiently discharge floating pieces of waste in the bowl portion 8 into the drainage conduit 12 while allowing them to sink into pooled water, thereby improving waste discharge performance.

In the flush toilet 1 according to the above embodiment, the area A1 of the front bottom surface 40 is set to be greater than one-half of the area A2 of the pooled water surface, so that the major stream m of flush water spouted from the second spout port 24 dives down from the left wall surface 38*a* to the front bottom surface 40 of the recess 20, thereby effectively forming a flow for agitating pooled water in the up-down direction along the right wall surface 38*b* of the recess 20. That is, it is possible to sufficiently flush the entire waste-receiving surface 16 of the bowl portion 8 with respective flush water flows spouted from the first and second spout ports 22, 24, and generate an up-down agitation flow m within the recess 2. This makes it possible to efficiently discharge floating pieces of waste in the bowl portion 8 into the drainage conduit 12 while allowing them to sink into pooled water, thereby improving waste discharge performance.

In the flush toilet 1 according to the above embodiment, the bowl portion 8 is formed with the water guide channel 30 for allowing flush water spouted from the first spout port 22 to swirlingly flow along the inner peripheral surface 18*a* of the rim 18, wherein the water guide channel 30 is formed to extend from the first spout port 22 toward the front end of the bowl portion 8 while gradually inclining downwardly and then extending rearward from the front end while gradually inclining upwardly, so that it is possible to allow the flush water from the first spout port 22 to effectively flow, as a major stream M, from the front end of the bowl portion 8 into the recess 20.

In the flush toilet 1 according to the above embodiment, as illustrated in FIGS. 9 and 10, the waste-receiving surface 16 is formed to, along the line approximately equally distant from the rim 18 in the intermediate region of the waste-receiving surface 16 in its longitudinal direction, extends, in one of laterally opposite sides of the bowl portion 8, toward the front end of the bowl portion 8 while gradually inclining downwardly, and further extends, in the other side, toward the rear end of the bowl portion 8 while gradually inclining upwardly, so that it is possible to allow a part ml of the flush water spouted from the second spout port 24 to flow into the recess 20 from the forward side thereof, after merging with the flush water spouted from the first spout port 22 and flowing, as a major flow M, from the front end of the bowl portion 8 into the recess 22.

In the flush toilet 1 according to the above embodiment, the opening cross-section D1 of the first spout port 22 is formed in a vertically-long flat shape, so that it is possible to allow flush water spouted from the first spout port 22 to swirlingly flow to the front end of the bowl portion while avoiding an undesirable situation where the flush water spouted from the first spout port 22 immediately falls onto the waste-receiving surface 16, thereby effectively forming a major flow M flowing from the front end of the bowl portion 8 into the recess 20.

Although the above embodiment has been described based on an example where the flush toilet 1 is a wash-down type, the flush toilet of the present invention may be a type configured to suck waste in a bowl portion by means of a siphon action so as to discharge the waste to the outside via a drainage trap duct at a burst, so-called "siphon type".

What is claimed is:

1. A flush toilet for flushing a toilet main unit with flush water supplied from a flush water source to thereby discharge waste, comprising:

a bowl portion having a bowl-shaped waste-receiving surface, a rim located along an upper edge thereof, and a recess formed below the waste-receiving surface, the recess having a bottom located below a pooled water level, and a wall connecting between the bottom and a lower edge of the waste-receiving surface;

a first rim spout portion located on one of laterally opposite sides of the bowl portion, and configured to spout flush water toward a front end of the bowl portion so as to form a swirl flow which swirlingly flows along an inner peripheral surface of the rim;

a second rim spout portion located on the other of laterally opposite sides of the bowl portion, and configured to spout flush water so as to form a swirl flow having a same flow direction as that of the swirl flow formed by the first rim spout portion; and a drainage conduit having an inlet connecting with the recess so as to discharge waste therethrough, wherein the bowl portion is configured to allow flush water spouted from the first rim spout portion to form a major stream which flows from the front end of the bowl portion into the recess, and allow flush water spouted from the second rim spout portion to flow into the major stream from a transverse direction in the recess so that the pooled water in the recess is agitated in the up-down direction.

2. The flush toilet according to claim 1, wherein the bowl portion is configured to allow most of the flush water spouted from the second rim spout portion to flow into the recess from the lateral side of the bowl portion.

3. The flush toilet according to claim 1, wherein the waste-receiving surface of the bowl portion has a rear waste-receiving sub-surface in a rear region thereof, the rear waste-receiving sub-surface being formed in a shelf shape in a downstream area of the second rim spout portion, in such a manner as to allow the flush water spouted from the second rim spout portion to be guided to a front region of the recess while flowing thereon.

4. The flush toilet according to claim 2, wherein the waste-receiving surface of the bowl portion has a rear waste-receiving sub-surface in a rear region thereof, the rear waste-receiving sub-surface being formed in a shelf shape in a downstream area of the second rim spout portion, in such a manner as to allow the flush water spouted from the second rim spout portion to be guided to a front region of the recess while flowing thereon.

5. The flush toilet according to claim 3, which satisfies the following relationship: $2 \leq L/w2 \leq 10$, where L represents a width of the shelf-shaped rear waste-receiving sub-surface, and w2 represents a width of the second rim spout portion.

6. The flush toilet according to claim 3, wherein the recess is configured, in top plan view, such that the bottom is formed in the front region thereof, and an area of the bottom is equal to or greater than one-half of an area of a pooled water surface.

7. The flush toilet according to claim 4, wherein the recess is configured, in top plan view, such that the bottom is formed in the front region thereof, and an area of the bottom is equal to or greater than one-half of an area of a pooled water surface.

8. The flush toilet according to claim 1, wherein the bowl portion is formed with a water guide channel for allowing the flush water spouted from the first rim spout portion to swirlingly flow along the inner peripheral surface of the rim, the water guide channel being formed to extend from the first rim spout portion toward the front end of the bowl portion while gradually inclining downwardly and then extend rearwardly from the front end while gradually inclining upwardly.

9. The flush toilet according to claim 2, wherein the bowl portion is formed with a water guide channel for allowing the flush water spouted from the first rim spout portion to swirlingly flow along the inner peripheral surface of the rim, the water guide channel being formed to extend from the first rim spout portion toward the front end of the bowl portion while gradually inclining downwardly and then extend rearwardly from the front end while gradually inclining upwardly.

10. The flush toilet according to claim 3, wherein the bowl portion is formed with a water guide channel for allowing the flush water spouted from the first rim spout portion to swirlingly flow along the inner peripheral surface of the rim, the water guide channel being formed to extend from the first rim spout portion toward the front end of the bowl portion while gradually inclining downwardly and then extend rearwardly from the front end while gradually inclining upwardly.

11. The flush toilet according to claim 4, wherein the bowl portion is formed with a water guide channel for allowing the flush water spouted from the first rim spout portion to swirlingly flow along the inner peripheral surface of the rim, the water guide channel being formed to extend from the first rim spout portion toward the front end of the bowl portion while gradually inclining downwardly and then extend rearwardly from the front end while gradually inclining upwardly.

12. The flush toilet according to claim 5, wherein the bowl portion is formed with a water guide channel for allowing the flush water spouted from the first rim spout portion to swirlingly flow along the inner peripheral surface of the rim, the water guide channel being formed to extend from the first rim spout portion toward the front end of the bowl portion while gradually inclining downwardly and then extend rearwardly from the front end while gradually inclining upwardly.

13. The flush toilet according to claim 8, wherein the waste-receiving surface is formed to, along a line approximately equally distant from the rim in an intermediate region of the waste-receiving surface in a longitudinal direction thereof, extend, in the one of the laterally opposite sides, toward the front end of the bowl portion while gradually inclining downwardly, and further extend, in the other of the laterally opposite sides, toward a rear end of the bowl portion while gradually inclining upwardly.

14. The flush toilet according to claim 1, wherein the first rim spout portion has an opening formed in a vertically-long flat shape.

15. The flush toilet according to claim 2, wherein the first rim spout portion has an opening formed in a vertically-long flat shape.

16. The flush toilet according to claim 3, wherein the first rim spout portion has an opening formed in a vertically-long flat shape.

17. The flush toilet according to claim 5, wherein the first rim spout portion has an opening formed in a vertically-long flat shape.

18. The flush toilet according to claim 6, wherein the first rim spout portion has an opening formed in a vertically-long flat shape.

19. The flush toilet according to claim 8, wherein the first rim spout portion has an opening formed in a vertically-long flat shape.

20. The flush toilet according to claim 13, wherein the first rim spout portion has an opening formed in a vertically-long flat shape.

* * * * *